US012117253B2

(12) United States Patent
Edwards et al.

(10) Patent No.: US 12,117,253 B2
(45) Date of Patent: Oct. 15, 2024

(54) HIGH RELIABILITY, MICROCHANNEL HEAT PIPE ARRAY FOR IMPROVED EFFICIENCY, SIMPLIFIED CHARGING/DISCHARGING AND LOW-COST MANUFACTURE

(71) Applicant: Phononic, Inc., Durham, NC (US)

(72) Inventors: Jesse W. Edwards, Wake Forest, NC (US); Abhishek Yadav, Cary, NC (US); Simbarashe Nyika, Durham, NC (US); Devon Newman, Salt Lake City, UT (US)

(73) Assignee: Phononic, Inc., Durham, NC (US)

( * ) Notice: Subject to any disclaimer, the term of this patent is extended or adjusted under 35 U.S.C. 154(b) by 0 days.

(21) Appl. No.: 17/861,830

(22) Filed: Jul. 11, 2022

(65) Prior Publication Data

US 2023/0008028 A1 Jan. 12, 2023

Related U.S. Application Data

(60) Provisional application No. 63/220,368, filed on Jul. 9, 2021.

(51) Int. Cl.
*F28F 9/16* (2006.01)
*F28F 9/02* (2006.01)

(52) U.S. Cl.
CPC ..... *F28F 9/16* (2013.01); *F28F 9/0246* (2013.01); *F28F 2260/02* (2013.01)

(58) Field of Classification Search
CPC ..... F28F 9/16; F28F 9/0246; F28F 2260/02
See application file for complete search history.

(56) References Cited

U.S. PATENT DOCUMENTS 5,934,366 A * 8/1999 Gowan ..... F28F 9/0212 165/173
6,119,767 A * 9/2000 Kadota ..... F28F 1/126 165/104.33

(Continued)

FOREIGN PATENT DOCUMENTS

KR 20050065491 A 6/2005
WO 2020176746 A1 9/2020

OTHER PUBLICATIONS

International Search Report and Written Opinion for International Patent Application No. PCT/US2022/036680, mailed Oct. 14, 2022, 11 pages.

*Primary Examiner* — Raheena R Malik
(74) *Attorney, Agent, or Firm* — Withrow + Terranova, PLLC

(57) ABSTRACT

Systems and method for providing a micro-channel array are provided. In some embodiments, a micro-channel array includes a plurality of micro-channels having a first end and a second end; where at least one of the first end and the second end allows fluid connectivity between the plurality of micro-channels. In some embodiments, the micro-channel array includes external manifolding for fluid connectivity between the plurality of micro-channels. In some embodiments, the micro-channel array includes internal manifolding for fluid connectivity between the plurality of micro-channels. This may solve one of the largest causes of low yields and poor performance consistency in the production process while at the same time simplifying production and reducing production costs.

7 Claims, 8 Drawing Sheets

(56) References Cited

U.S. PATENT DOCUMENTS

| | | | | |
|---|---|---|---|---|
| 6,145,589 | A * | 11/2000 | Gowan | F28F 9/16 165/173 |
| 9,144,180 | B2 | 9/2015 | Olsson et al. | |
| 9,581,362 | B2 | 2/2017 | Stanley et al. | |
| 9,593,871 | B2 | 3/2017 | Stanley et al. | |
| 9,829,251 | B2 | 11/2017 | Peterle et al. | |
| 10,196,965 | B1 * | 2/2019 | Xu | F02B 29/045 |
| 10,458,683 | B2 | 10/2019 | Edwards et al. | |
| 11,147,188 | B2 * | 10/2021 | Fuller | H05K 7/20318 |
| 2013/0258594 | A1 * | 10/2013 | Gradinger | F28D 15/02 165/104.21 |
| 2013/0291555 | A1 | 11/2013 | Edwards et al. | |
| 2015/0075184 | A1 | 3/2015 | Edwards et al. | |
| 2017/0059253 | A1 * | 3/2017 | Laurila | F28F 1/32 |
| 2018/0338392 | A1 * | 11/2018 | Fuller | H05K 7/206 |
| 2019/0017740 | A1 | 1/2019 | Fei et al. | |
| 2021/0199353 | A1 | 7/2021 | Edwards et al. | |
| 2022/0146122 | A1 * | 5/2022 | Stegall | F28F 1/022 |

* cited by examiner

HIGH RELIABILITY, MICROCHANNEL HEAT PIPE ARRAY FOR IMPROVED EFFICIENCY, SIMPLIFIED CHARGING/DISCHARGING AND LOW-COST MANUFACTURE

RELATED APPLICATIONS

This application claims the benefit of provisional patent application Ser. No. 63/220,368, filed Jul. 9, 2021, the disclosure of which is hereby incorporated herein by reference in its entirety.

FIELD OF THE DISCLOSURE

The current disclosure relates generally to heat pipe arrays.

BACKGROUND

Microchannel heat-pipe/thermosiphon arrays typically consist of banks of small extruded rectangular channels, usually on the order of single millimeters, which are charged with a working fluid (refrigerant) and sealed at each end, such that each millimeter-scale channel forms a separate and independent heat-pipe/thermosiphon. Together these multi-channel arrays provide scalable transport capacity comparable to much larger single tube/pipe assemblies. In addition, charging and discharging of rectangular channels, both individually and as an assembly, is complex, difficult, and has poor repeatability. As such, improved systems and methods for heat pipes are needed.

SUMMARY

Systems and method for providing a micro-channel array are provided. In some embodiments, a micro-channel array includes a plurality of micro-channels having a first end and a second end; where at least one of the first end and the second end allows fluid connectivity between the plurality of micro-channels. In some embodiments, the micro-channel array includes external manifolding for fluid connectivity between the plurality of micro-channels. In some embodiments, the micro-channel array includes internal manifolding for fluid connectivity between the plurality of micro-channels. This may solve one of the largest causes of low yields and poor performance consistency in the production process while at the same time simplifying production and reducing production costs.

In some embodiments, the external manifolding comprises a small diameter tube with holes spaced/sized to match the microchannel dimensions for fluid connectivity between the plurality of micro-channels.

In some embodiments, the external manifolding is brazed to the micro-channel extrusion for fluid connectivity between the plurality of micro-channels.

In some embodiments, the external manifolding comprises a machined and/or stamped end cap with molded stand-off spacers sized to contain the internal pressures and allow for working fluid transfer between parallel channels.

In some embodiments, the external manifolding comprises no stress concentration features such as long straight slots.

In some embodiments, the external manifolding can be interfaced with sufficient surface area of the micro-channel array.

In some embodiments, the internal manifolding for fluid connectivity between the plurality of micro-channels comprises: a slot cut into the base webbing between interior channels, leaving the outer most channel wall on each end undisturbed for sealing.

In some embodiments, the internal manifolding is one or more of: compressed; cold welded; and brazed, to seal the micro-channel array.

In some embodiments, the micro-channel array also includes a charging port able to charge all of the plurality of micro-channels.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 1A:
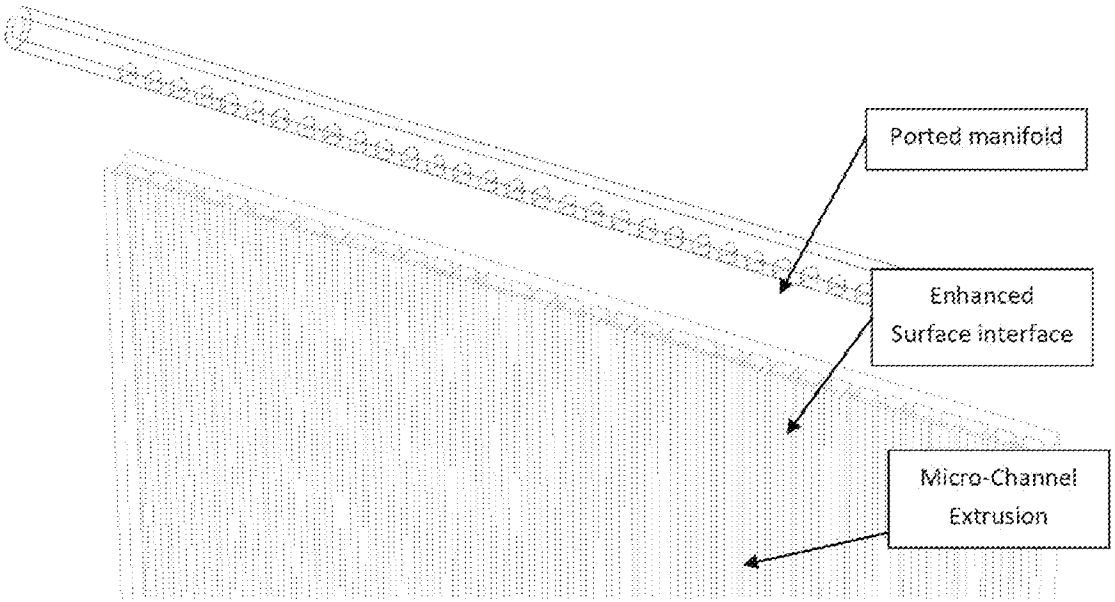
FIGS. 1A and 1B illustrate micro-channel extrusions according to some embodiments.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Microchannel heat-pipe/thermosiphon arrays typically consist of banks of small extruded rectangular channels, usually on the order of single millimeters, which are charged with a working fluid (refrigerant) and sealed at each end, such that each millimeter-scale channel forms a separate and independent heat-pipe/thermosiphon. Together, these multi-channel arrays provide scalable transport capacity comparable to much larger single tube/pipe assemblies. In addition, charging and discharging of rectangular channels, individually and as an assembly is complex, difficult and has poor repeatability.

The movement/balance of any working fluid, from any one channel tube in the array to any other, is completely restricted by this process of manufacture. This often results in an imbalance of refrigerant mass from tube to tube in the array, causing the working fluid distribution between the channels to be uneven, even if the total refrigerant charge can be measured as appropriate. This uneven distribution often results in localized flooding and burnout conditions from tube to tube that depress the overall functionality and efficiency of the microchannel assembly. This charge imbalance is extremely difficult to detect and cannot be corrected after final assembly due to the inherent isolation of each micro-channel tube from any others in the array.

The traditional solution to avoid the above detailed poor performance through charge imbalance is the interconnection of channels using a tube manifold to enclose and seal one end of the micro channel array. One end of the micro channel is sealed using traditional metal joining techniques such as cold welding or brazing. The other end is attached to a round tube (manifold), prepared with a slot cut in it along its long axis sized to accept the insertion of a still open end of the microchannel array. After the microchannel array is inserted into the prepared slot, the edges are sealed through traditional brazing or welding. One of the manifold tube ends is also sealed during the sealing of the microchannel array and the manifold tube. The other end of the manifold tube is often first used for charging of the working fluid (refrigerant) and then also sealed in a traditional manner (braze, crimp, weld, etc.). The open side of the manifold tube may also have a valve or fitting installed either during the sealing process or in a separate process, for easier field repair. The tube can be on the condenser or evaporator ends of the heat-pipe/thermosiphon. The tube manifold allows for movement of fluid between individual microchannels, which improves efficiency for non-uniform spatial heat loads. At the same time, the free flow of the working fluid from tube to tube through the manifold reduces the sensitivity of the heat-pipe/thermosiphon to overcharging or undercharging. Unfortunately, this mitigation method can be an expensive process, but it does provide a reasonably effective solution in lower pressure applications. However, the square slot at the manifold to micro-channel interface becomes a near certain failure point in any higher pressure application.

Systems and method for providing a micro-channel array are provided. In some embodiments, a micro-channel array includes a plurality of micro-channels having a first end and a second end; where at least one of the first end and the second end allows fluid connectivity between the plurality of micro-channels. In some embodiments, the micro-channel array includes external manifolding for fluid connectivity between the plurality of micro-channels. In some embodiments, the micro-channel array includes internal manifolding for fluid connectivity between the plurality of micro-channels. This may solve one of the largest causes of low yields and poor performance consistency in the production process while at the same time simplifying production and reducing production costs.

In some embodiments, the micro-channel array disclosed herein could be used with an insulated container with active refrigeration system. Additional details can be found in International Patent Application serial number PCT/US2020/067172, filed Dec. 28, 2020, the disclosure of which is hereby incorporated herein by reference in its entirety; and U.S. patent application Ser. No. 17/135,420, filed on Dec. 28, 2020, the disclosure of which is hereby incorporated herein by reference in its entirety. Both of these claim priority to Provisional Patent Application Ser. No. 62/953,771, filed Dec. 26, 2019.

In some embodiments, a control scheme includes one or more of the control schemes described in U.S. Patent Application Publication US 2013/0291555, U.S. Patent Application Publication US 2015/0075184, U.S. Pat. No. 9,581,362, U.S. Pat. No. 10,458,683, and U.S. Pat. No. 9,593,871, which are in incorporated herein by reference. In some embodiments, a thermal module includes a heat pump such as that described in U.S. Pat. No. 9,144,180, which is incorporated herein by reference. For heat extraction (i.e., heat accept) and heat rejection, the thermal module may include, for example, a heat accept system (e.g., thermosiphons, micro-channel array, or other passive or active heat exchange component(s) for transferring heat from an interior of the active cooler to a cold side of the TEC/heat pump) and a heat reject system (e.g., thermosiphons or other active or passive heat exchange components for transferring heat from a hot side of the TEC/heat pump to the ambient environment).

Figure 1B:
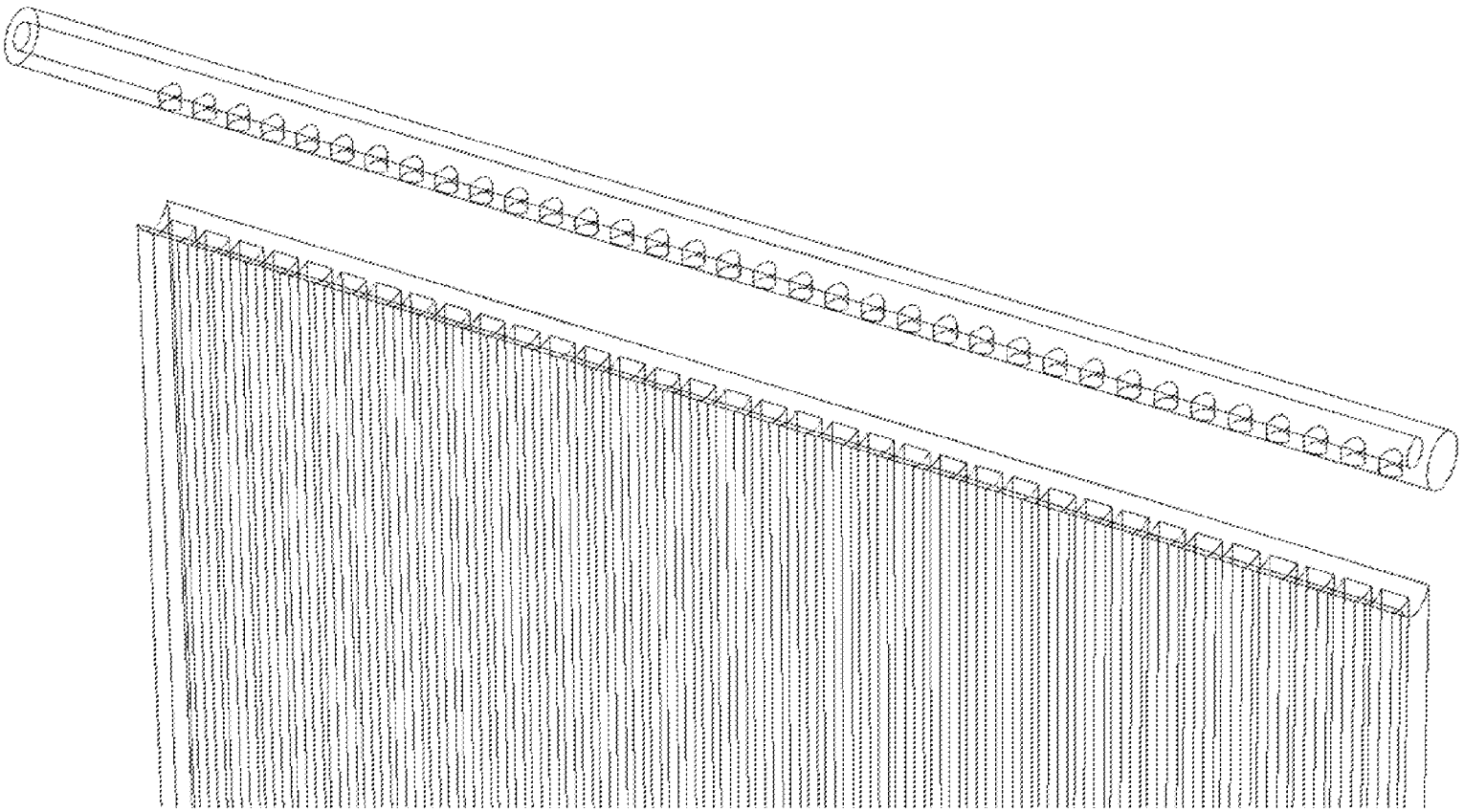
Figure 2A:
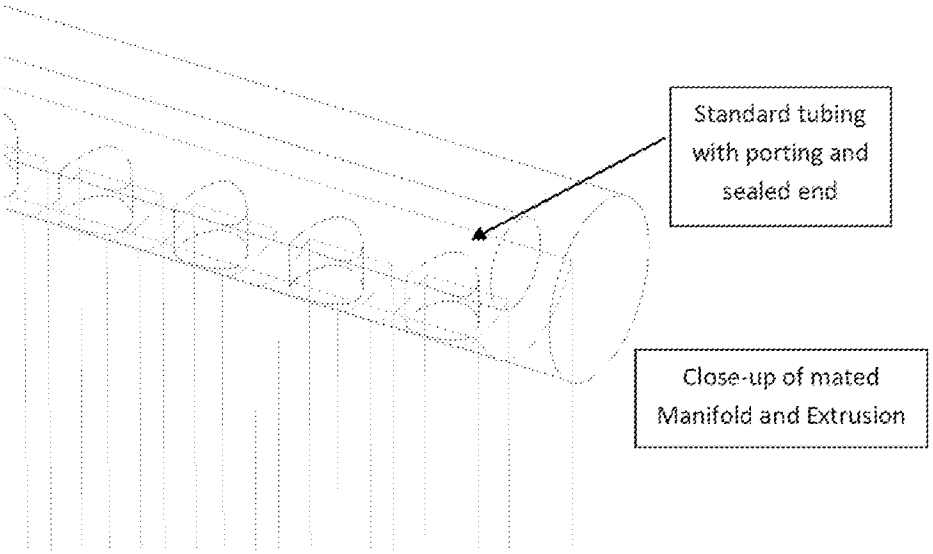
FIGS. 2A and 2B illustrate a close-up of mated Manifold and Extrusion according to some embodiments.
Figure 2B:
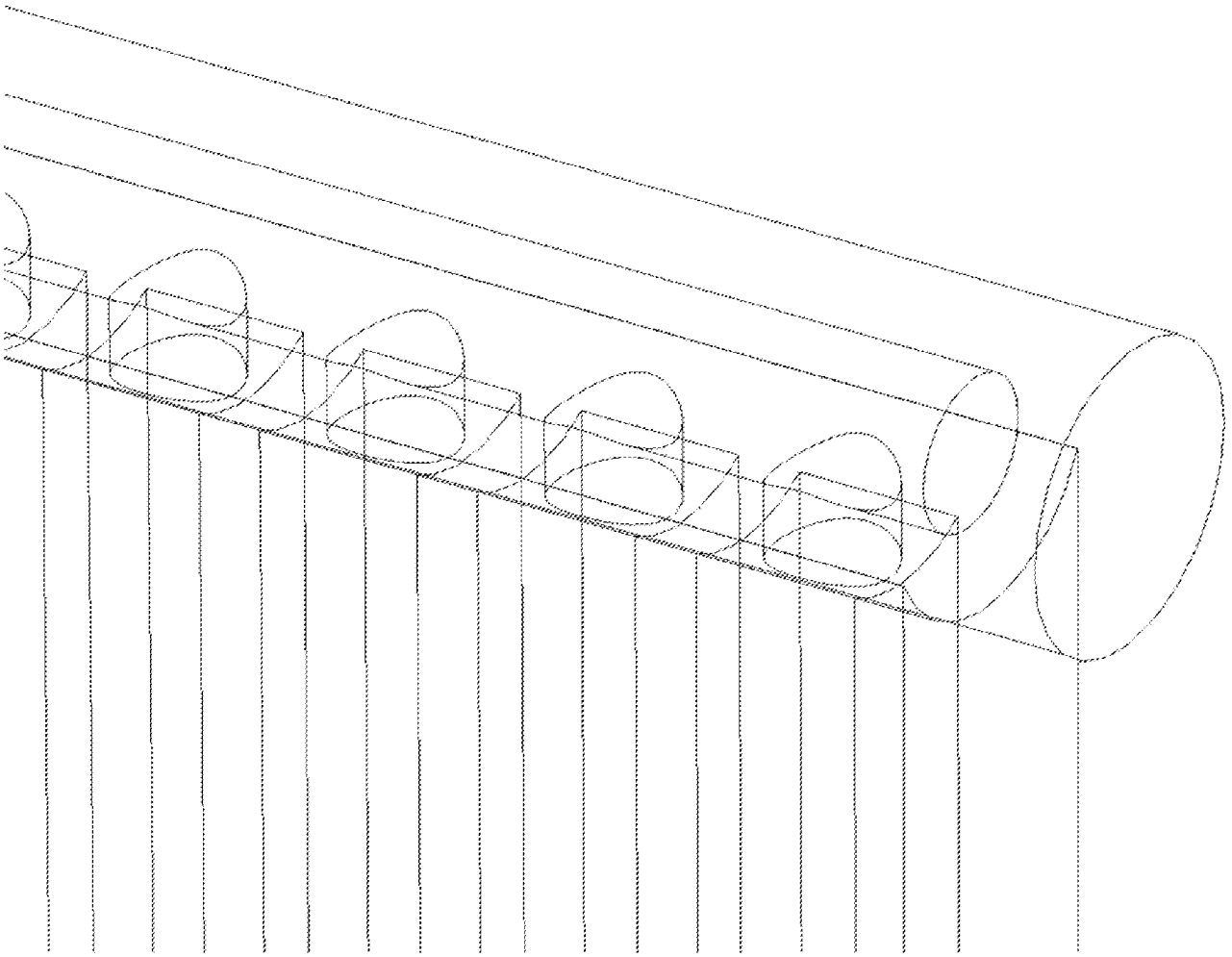

FIGS. 1A and 1B illustrate micro-channel extrusions according to some embodiments. FIGS. 2A and 2B illustrate a close-up of mated Manifold and Extrusion according to some embodiments. External manifolding: Small diameter tube with holes spaced/sized to match the microchannel dimensions and or materials and then brazed to the micro-channel extrusion. Machined/Stamped end cap with molded stand-off spacers sized to contain the internal pressures and allow for working fluid transfer between parallel channels.

The micro-channel array itself is inherently capable of supporting high internal pressures as a result of the small dimensions of the individual channels and the internal webbing between channels. The failure mode for these assemblies is almost exclusively related to the sealing incorporated into each end of the extrusion. Traditional external manifolding and sealing techniques are severely limited in medium to high pressure internal operating and storage conditions. To solve this issue, an external manifold can be created using an appropriately sized tube, sized for the target system pressure, with a series of integrated holes. By ensuring that the tubing has no stress concentration features, such as long straight slots, and that the manifold tube can be interfaced with sufficient surface area of the micro-channel array, the entire assembly can then be easily rated for high pressures with no risk of material failure in either the manifold of micro-channel array.

Figure 3A:
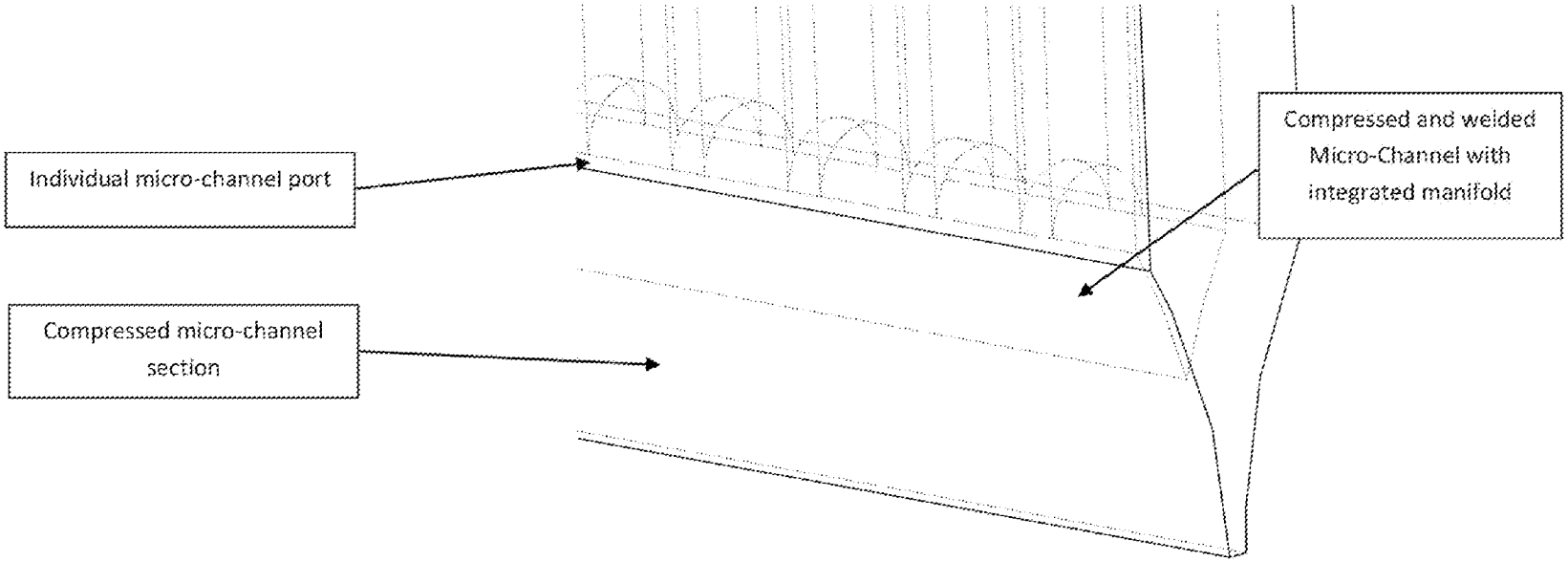
FIGS. 3A and 3B illustrate a Compressed and welded Micro-Channel with integrated manifold according to some embodiments.
Figure 3B:
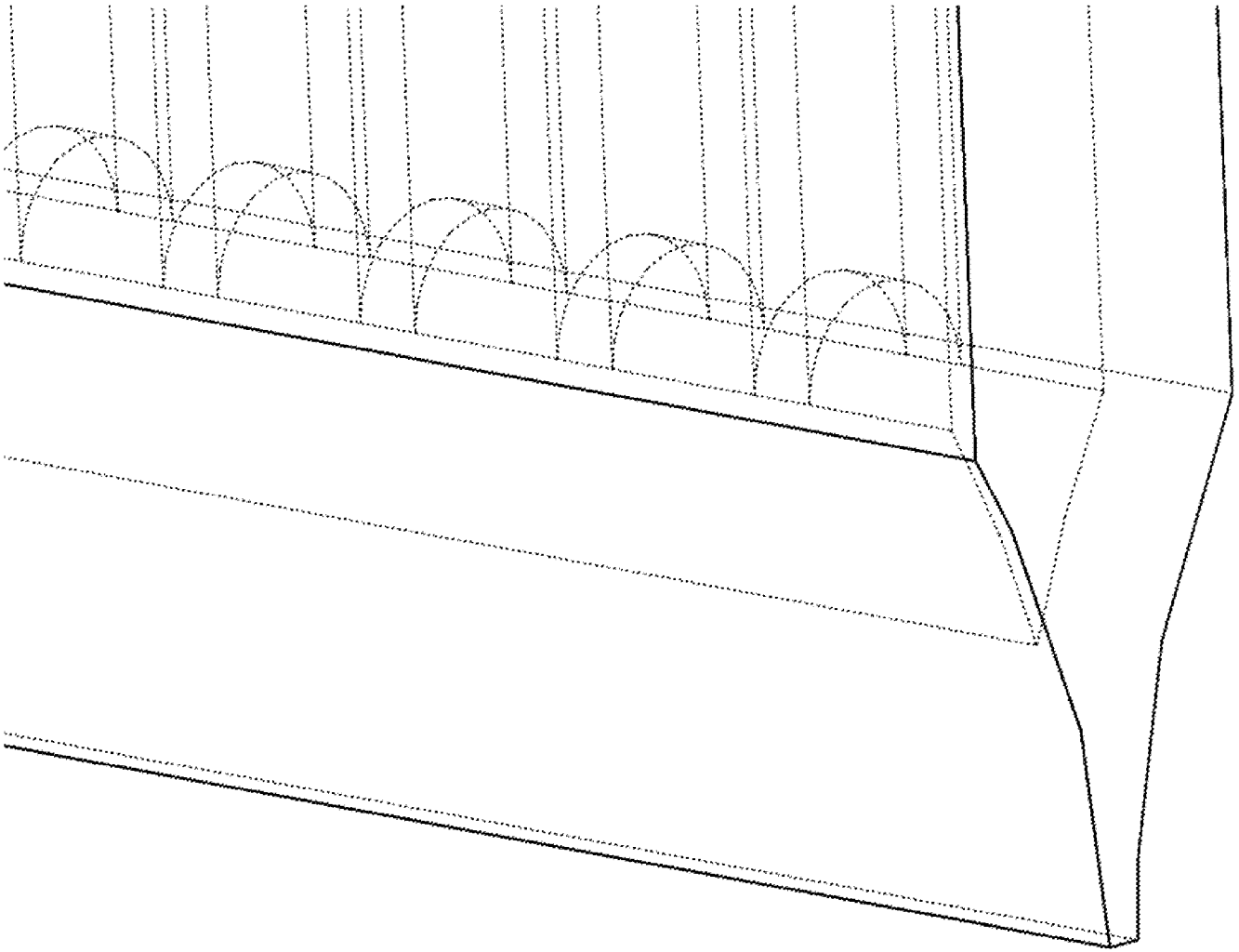
Figure 4A:
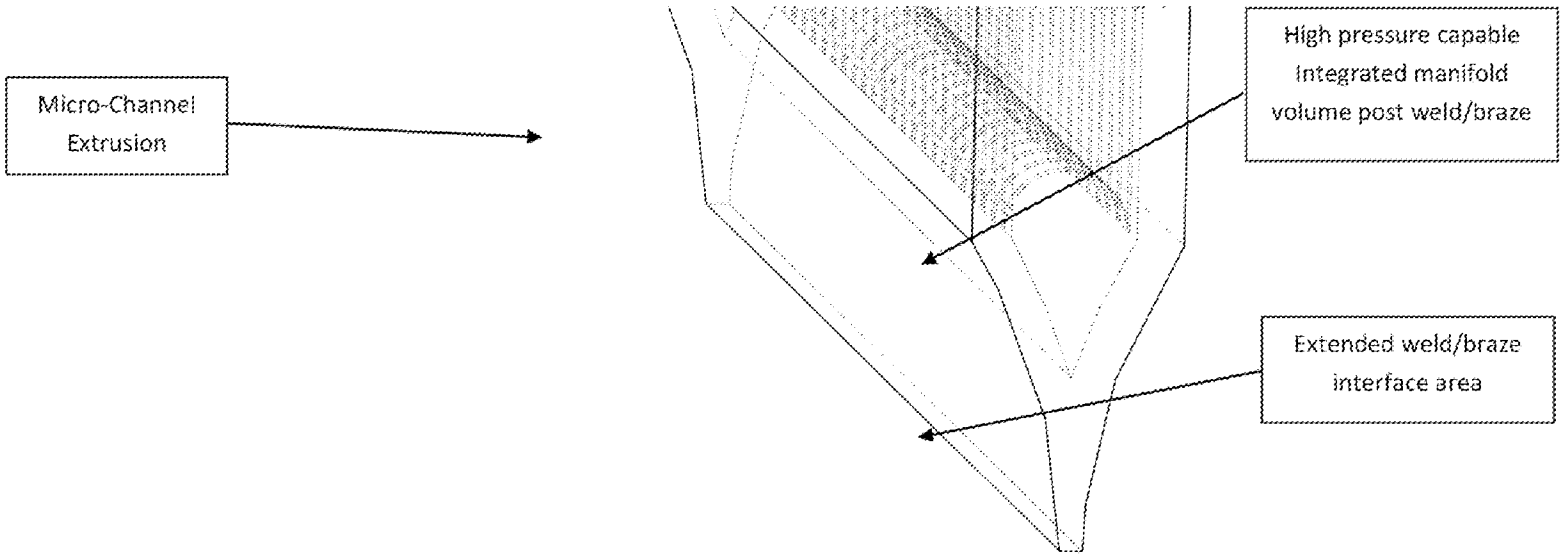
FIGS. 4A and 4B illustrate an Extended weld/braze interface area according to some embodiments.
Figure 4B:
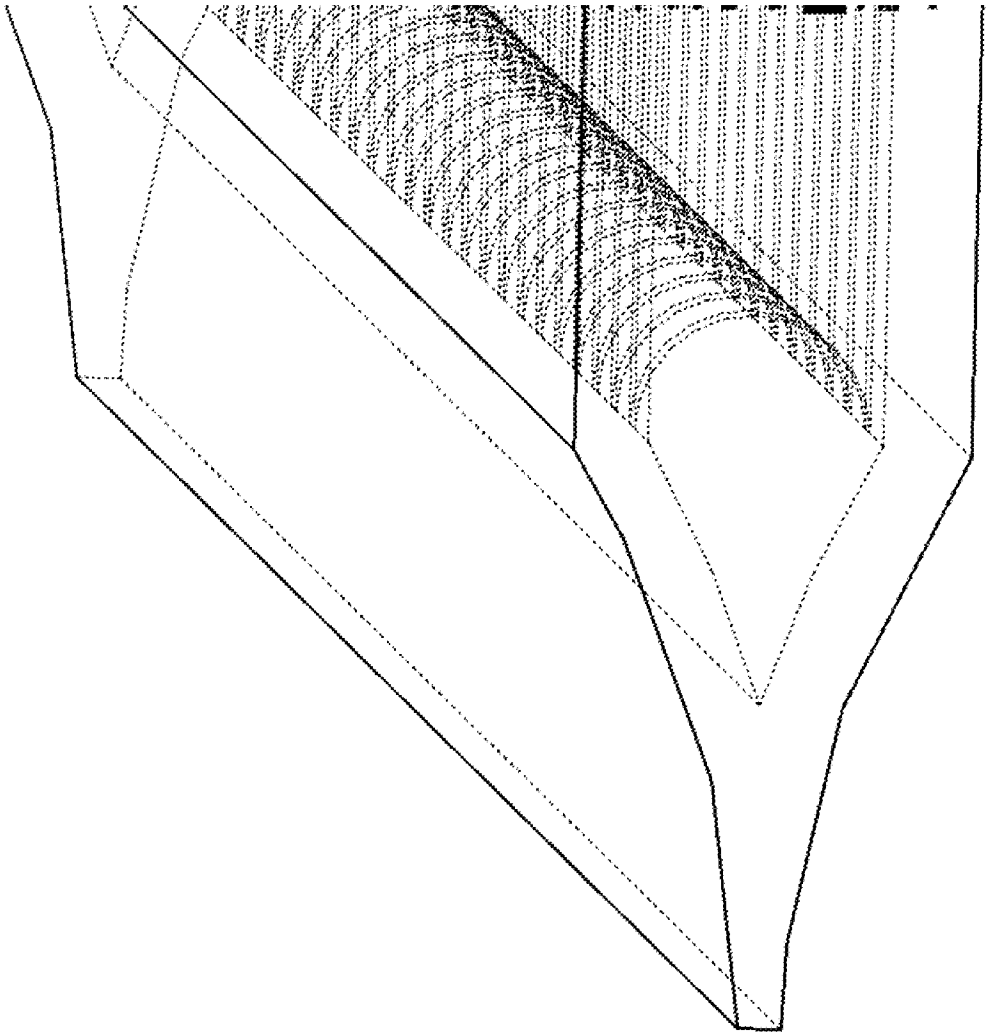

FIGS. 3A and 3B illustrate a Compressed and welded Micro-Channel with integrated manifold according to some embodiments. FIGS. 4A and 4B illustrate an Extended weld/braze interface area according to some embodiments. Internal manifolding: Slot cut into the base webbing between interior channels, leaving the outer most channel wall on each end undisturbed for sealing and then compressed and cold welded or brazed to seal.

The micro-channel array itself is inherently capable of supporting high internal pressures as a result of the small dimensions of the individual cannels and the internal webbing between channels. The failure mode for these assemblies is almost exclusively related to the sealing incorporated into each end of the extrusion. The most common method of sealing a microchannel heat-pipe/thermosiphon is by hydraulic compression of the extrusion along its short axis, perpendicular to the refrigerant recirculation path. The compressed micro-channel is then sealed by one or more processes (cold-welding, friction welding, brazing, welding, Tig/Mig welding, etc.). This process is normally sufficient for low pressure applications but is the primary failure mode for medium to high pressure applications. By removing a short section of webbing between the individual micro-channel ports on one or both ends of the micro-channel array, the available surface area for sealing is dramatically increased, providing significantly improves resistance to medium to high internal pressures. At the same time, this method will form an internal manifold that allows for easy migration of working fluid between the individual chambers. This manifold solves one of the largest causes of low yields and poor performance consistency in the production process while at the same time simplifying production and reducing production costs.

In some embodiments, being fluidly connected increases efficiency because all channels are equalized. Abrupt failure is more easily detectable since more than one channel will be affected. In some embodiments, the charging of the system is easier because a tube fitting can be used instead of the flat fitting. This also makes field repairs more possible.

Those skilled in the art will recognize improvements and modifications to the preferred embodiments of the present disclosure. All such improvements and modifications are considered within the scope of the concepts disclosed herein and the claims that follow.

What is claimed is:

1. A method of manufacturing a micro-channel array comprising:

providing a plurality of micro-channels having a first end and a second end;

providing external manifolding for fluid connectivity between the plurality of micro-channels; and machining and/or stamping an end cap of the external manifolding with molded stand-off spacers sized to contain internal pressures and allow for working fluid transfer between parallel channels;

where at least one of the first end and the second end allows fluid connectivity between the plurality of micro-channels.

2. The method of claim 1 wherein the external manifolding comprises a small diameter tube with holes spaced/sized to match microchannel dimensions, for fluid connectivity between the plurality of micro-channels.

3. The method of claim 2 further comprising:

brazing the external manifolding to a micro-channel extrusion, for fluid connectivity between the plurality of micro-channels.

4. The method of claim 1 wherein the external manifolding comprises no stress concentration features.

5. The method of claim 1 further comprising:

providing internal manifolding for fluid connectivity between the plurality of micro-channels.

6. The method of claim 5 further comprising:

cutting a slot into base webbing between interior channels of the internal manifolding, leaving an outer most channel wall on each end undisturbed for sealing.

7. The method of claim 6 further comprising:

one or more of: compressing; cold welding; and brazing the internal manifolding to seal the micro-channel array.

* * * * *